US005183187A

United States Patent [19]

Martin et al.

[11] Patent Number: 5,183,187

[45] Date of Patent: Feb. 2, 1993

[54] PISTON OPERATED FLUID DISPENSING DEVICE

[76] Inventors: James H. Martin; Samuel J. Garro, both of c/o The Mahagawa Corporation, P.O. Box 478, Wadsworth, Ohio 44281

[21] Appl. No.: 712,677

[22] Filed: Jun. 10, 1991

[51] Int. Cl.[5] ..... B65D 37/00; B65D 83/14

[52] U.S. Cl. ..... 222/287; 222/309; 222/335; 222/341; 222/402.2

[58] Field of Search ..... 222/402.2, 335, 336, 222/340, 341, 387, 389, 309, 282, 287, 288, 144.5

[56] References Cited

U.S. PATENT DOCUMENTS

| | | | |
|---|---|---|---|
| 3,018,928 | 1/1962 | Meshberg | 222/402.2 X |
| 3,033,425 | 5/1962 | Gawthrop | 222/335 |
| 3,055,560 | 9/1962 | Meshberg | 222/402.2 |
| 3,104,785 | 9/1963 | Beard, Jr. | 222/335 X |
| 3,180,535 | 4/1965 | Ward | 222/335 |
| 3,221,946 | 12/1965 | Riley | 222/402.2 X |
| 3,511,418 | 5/1970 | Venus, Jr. | 222/402.2 |
| 4,427,137 | 1/1984 | Dubini | 222/288 X |
| 4,577,784 | 3/1986 | Brunet | 222/402.2 |
| 4,892,232 | 1/1990 | Martin | 222/386.5 X |

FOREIGN PATENT DOCUMENTS

| | | | |
|---|---|---|---|
| 1804838 | 6/1970 | Fed. Rep. of Germany | 222/335 |
| 1307978 | 9/1962 | France | 222/335 |

*Primary Examiner*—Kevin P. Shaver
*Attorney, Agent, or Firm*—Edmond T. Patnaude

[57] ABSTRACT

In a fluid dispenser a spring biased piston is mounted for reciprocable movement along a stem member which is moved longitudinally to actuate the dispenser. A metering chamber is located between the end of the piston and the end wall of a cylindrical chamber in which the piston is mounted, and axial passageways extending from opposite ends of the stem connect the metering chamber to a discharge location when the stem is in a discharge positon and connect the metering chamber to a fluid reservoir when the stem is in a fill position.

6 Claims, 4 Drawing Sheets

PISTON OPERATED FLUID DISPENSING DEVICE

BACKGROUND OF THE INVENTION

1. Field of the Invention

This invention relates generally to dispensing apparatus for a fluid under pressure, and more specifically, this invention relates to dispensing apparatus for a liquid under pressure that utilizes a piston to dispense a predetermined quantity of the liquid.

2. Description of the Prior Art

As pointed out in applicant's earlier U.S. Pat. No. 4,892,232, there are disadvantages to prior art finger operated pumps for dispensing a small amount of liquid from a container. In particular, one cannot count upon obtaining the same amount of liquid each time because the speed and the extent of stroke of the actuator affect the quantity of liquid dispensed.

In U.S. Pat. No. 4,892,232, an arrangement is provided for achieving the dispensing of a predetermined quantity of liquid with each actuation of the dispensing apparatus. In that device, a resilient and collapsible metering reservoir is positioned in the liquid under pressure. With that structure, it is possible to obtain dispensing of a substantially constant amount of the liquid upon each actuation of the dispensing apparatus. While this device is quite successful in dispensing the desired amount of liquid, there are instances in which it is preferable to achieve dispensing of a predetermined quantity of liquid using only mechanical elements rather than the elastomeric metering reservoir.

SUMMARY OF THE INVENTION

The present invention employs an arrangement utilizing a piston to achieve dispensing of a predetermined quantity of fluid without the requirement of an elastomeric member. In the structure of this invention, a valve assembly is located at one end of a container in which liquid under pressure is located. The valve assembly has a body portion that extends from one end of the container into a pressurized fluid such as a liquid medicament which is the primary application described herein. A stem member is located within the body portion to be manually actuatable for reciprocating motion.

A piston is mounted for reciprocable motion along the stem member, with the piston being located adjacent the end of the stem member away from the end of the container. Between the surface of the piston toward the end of the container and an opposing surface on the body portion, a chamber is formed. This chamber has a capacity to contain at least the predetermined amount of liquid to be dispensed. A bias spring is located between the surfaces of the piston and the body portion. This bias spring provides a force under compression that is less than the force produced by the action of the pressurized liquid on the opposite surface of the piston.

A first passageway is formed in the stem member from a discharge location at the end where the dispensing is to occur to a point intermediate that end and the other end of the stem member. At the end of the passageway away from the dispensing or discharge location, an outlet is provided. This outlet is normally in conjunction with the body portion, but when the stem member is manually actuated it is moved into conjunction with the chamber to interconnect the chamber with the discharge location. A second bias spring is located between appropriate shoulders on the stem member and the body portion to maintain the stem member in the unactuated position under a manual actuating force is applied. In other embodiments the first and second bias springs may be replaced by a single bias spring between the piston and the stem member.

A second passageway is formed from the other end of the stem member to a point between that end of the stem member and the location of the outlet of the first passageway. An outlet for the second passageway is normally in conjunction with the chamber to interconnect the chamber with the pressurized fluid, but upon manual actuation of the stem member, this outlet is moved out of conjunction with the chamber. chamber.

The piston is located about the stem member adjacent the end away from the dispensing or discharge location and has a dimension along the stem member that is less than the length of the second passageway.

In the quiescent or unactuated state, the liquid under pressure passes into the chamber through the second passageway. Since the pressurized liquid in the chamber acting on that surface of the piston is approximately equal to the force produced by the action of the pressurized liquid on the other surface of the piston, the first bias spring maintains the piston adjacent the end of the stem member away from the dispensing location.

Upon manual actuation of the stem member, the outlet of the first passageway is placed in conjunction with the chamber, while the outlet of the second passageway is taken out of conjunction with the chamber. Thus, the first passageway connects the chamber to atmospheric pressure and the force of the liquid under pressure on the surface of the piston away from the chamber is greater than the force provided by the first bias spring. Accordingly, the piston is driven into the chamber to force the liquid contained therein out the first passageway to the dispensing location. The distance which the piston is driven is determined by a positive stop, such as the space occupied by the first bias spring when compressed, and thus the amount of liquid medicament forced out by the piston is always the desired dose.

In some applications a fixed or unit dose dispensing of the type described above is all that is needed. However, in other situations it is desirable to vary the dose being dispensed. This may be achieved by varying the size of the chamber, or at least the portion thereof that is traversed by the piston.

One way to achieve this is by adjusting the distance between the surface on the piston and the opposing surface on the body of the value assembly that define the chamber. This may be done by providing a threaded engagement between the stem member and a movable section of the body of the valve assembly. As the stem member is rotated, the movable section approaches or recedes from the piston to adjust the size of the chamber (stroke of the piston) and hence vary the amount of liquid dispensed.

Another approach is to utilize helically related surfaces on the piston and the body portion. A connection between the stem member and the piston (or a mating section of the body) permits relative rotation between the two surfaces to adjust the space therebetween and hence vary the amount of liquid dispensed.

These and other objects, advantages and features of this invention will hereinafter appear, and for purposes of illustration, but not of limitation, exemplary embodiments of the subject invention are shown in the appended drawing.

DETAILED DESCRIPTION OF THE PREFERRED EMBODIMENTS

Figure 1:
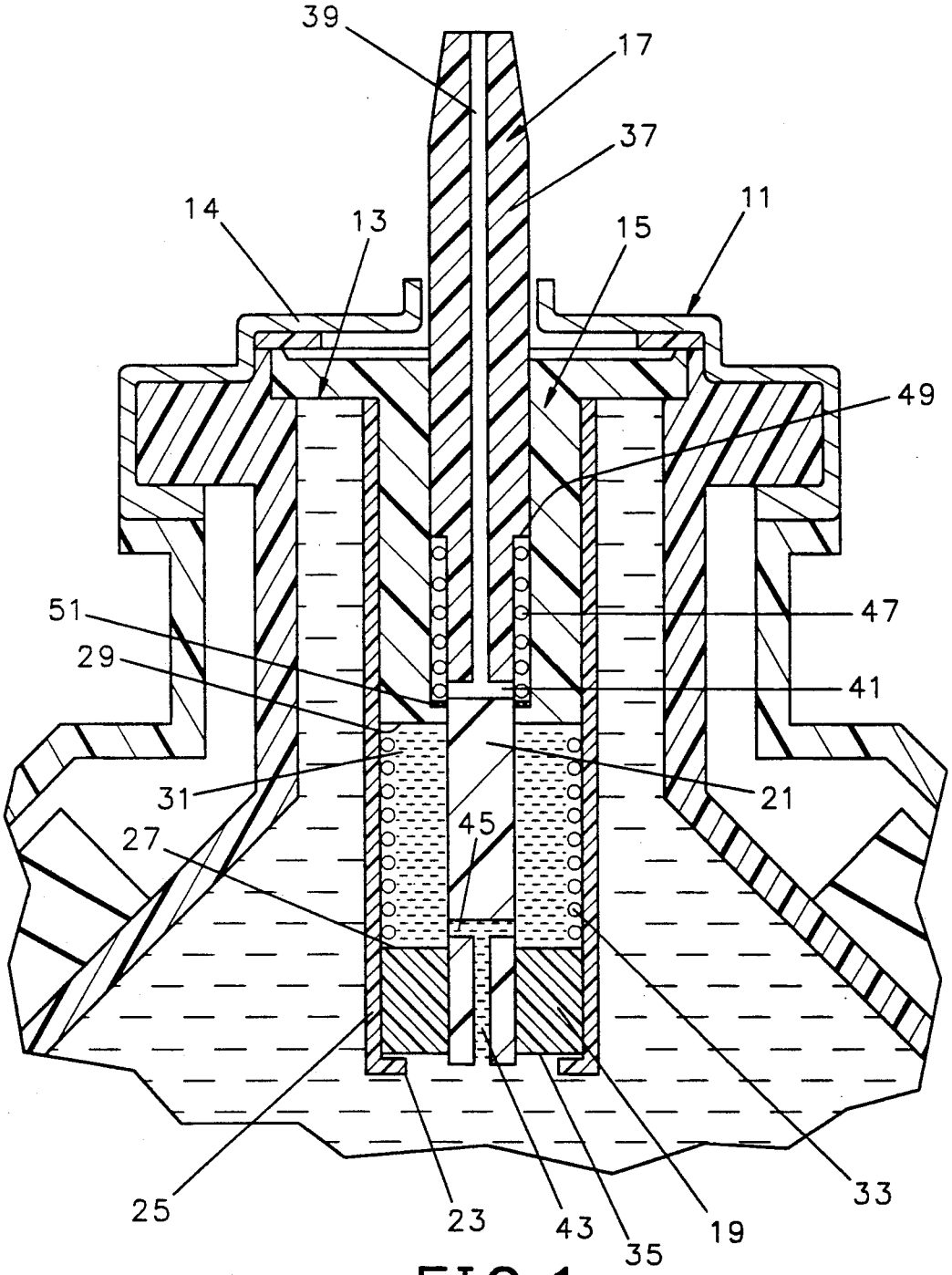
FIG. 1 is a partial cross-sectional view illustrating a first embodiment of the piston dispensing apparatus of this invention in the quiescent or unactuated state.
Figure 2:
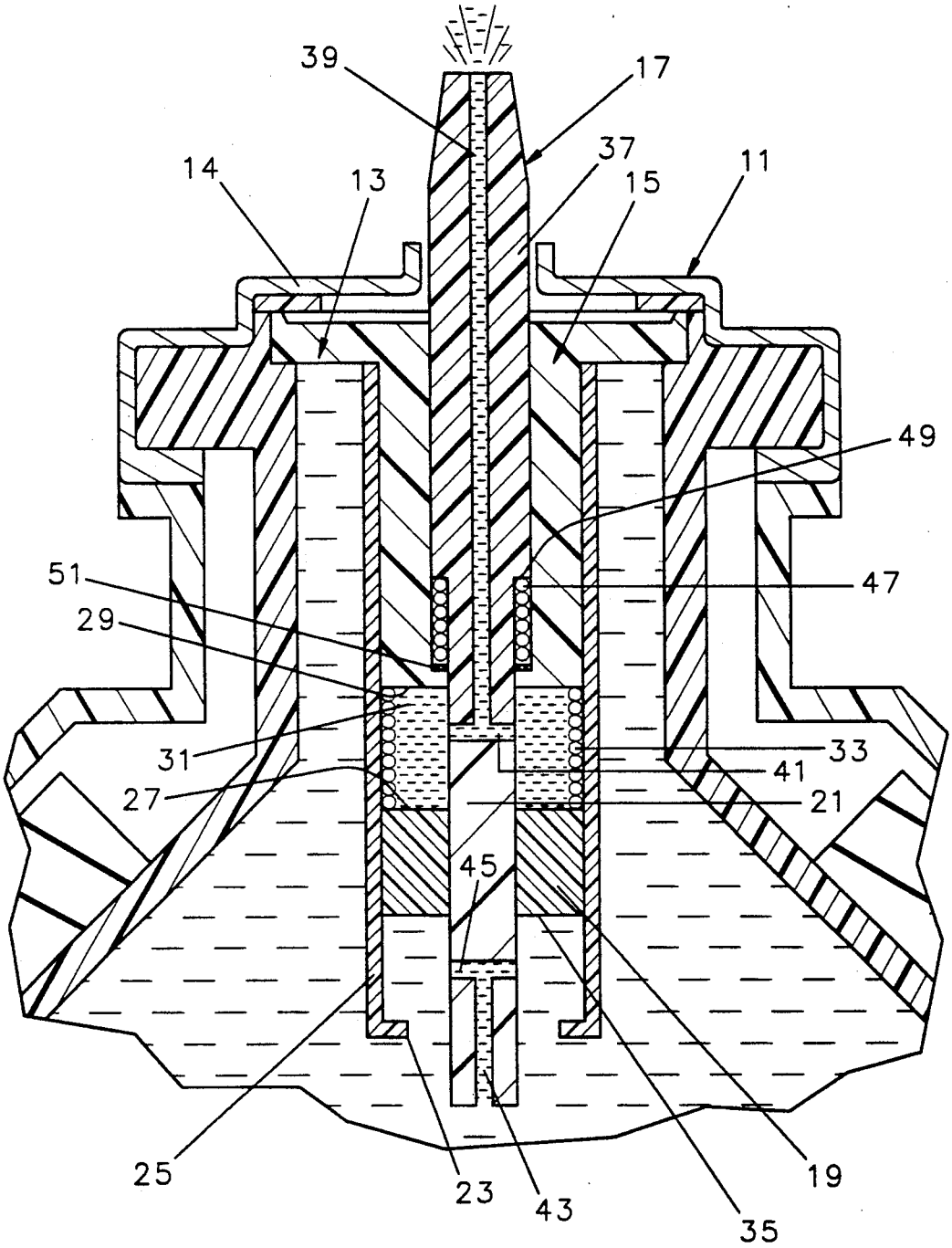
FIG. 2 is a partial cross-sectional view similar to FIG. 1 but with the dispensing apparatus in the dispensing or actuated position.

In FIGS. 1 and 2 of the drawing, a portion of a container for a fluid under pressure that is to be dispensed is shown. Container 11 may be any suitable type of dispensing device such as, for example, the device shown in FIGS. 1 and 2 of U.S. Pat. No. 4,892,232 for a liquid medicament.

A valve assembly 13 is mounted in the end 14 of container 11. Valve assembly 13 includes a body portion 15 and a stem member 17. Stem member 17 is mounted for reciprocable motion in the body portion 15.

A piston 19 is mounted about a reduced diameter section 21 of the stem member 17. Piston 19 is mounted for reciprocable motion along the section 21 of stem member 17. Piston 19 is prevented from sliding off the end of stem member 17 by an inwardly extending flange 23 at the end of an elongated portion 25 of the housing 15. Surface 27 of piston 19 and an opposing surface 29 on body portion 15 form a chamber 31. Chamber 31 has a size such that it has the capacity to contain at least the predetermined quantity of pressurized liquid to be dispensed.

A bias spring 33 is located between the surfaces 27 and 29. Bias spring 33 provides a force under compression that is less than the force developed on surface 35 of piston 19 by the action of the pressurized liquid.

In the larger diameter section of stem member 17, a passageway 39 is formed. Passageway 39 extends from the dispensing location outside of container 11 to a point intermediate the ends of the stem member 17. An outlet 41, shown here as an opening through the diameter of the stem member 17, extends to the side of stem member 17.

Another passageway 43 is formed in the other end of stem member 17. Passageway 43 extends from the second end of stem member 17 to an outlet 45, which is also shown as a diametrical opening. Thus, both passageway 39 and passageway 43 have essentially a T-shape.

Another bias spring 47 is located between a shoulder 49 on stem member 17 and a shoulder 51 on body portion 15. Bias spring 47 serves to keep the stem member 17 in the unactuated position of FIG. 1, unless it is manually depressed against the force of spring 47. It may be noted that bias springs 33 and 47 may be replaced by a single bias spring between stem member 17 and piston 19.

In the quiescent or non-actuated position of FIG. 1, the pressurized liquid passes into chamber 31 through passageway 43. Outlet 41 of passageway 39 is not in conjunction with the chamber 31, and thus chamber 31 is sealed from the atmosphere.

Upon manual depression of stem member 17 to the dispensing position shown in FIG. 2, outlet 41 of passage 39 is brought in conjunction with chamber 31. In this position, chamber 31 is connected to atmospheric pressure through passageway 39.

At the same time, outlet 45 of passageway 43 is moved out of conjunction with the chamber 31, so that the amount of liquid in chamber 31 is maintained at the quantity that was there prior to actuation. Also, since chamber 31 is now at atmospheric pressure, and since the relative pressure of the liquid on surface 35 of piston is greater than the force of the spring 33 under compression, piston 19 is driven to the position shown in FIG. 2. This forces out the desired amount of the liquid to be dispensed. The amount of liquid dispensed with each actuation is substantially the same to a great degree of accuracy.

Upon removal of the manual actuating force, bias spring 47 returns stem member 17 to the position of FIG. 1 and the apparatus is prepared to dispense another unit dose.

Figure 3:
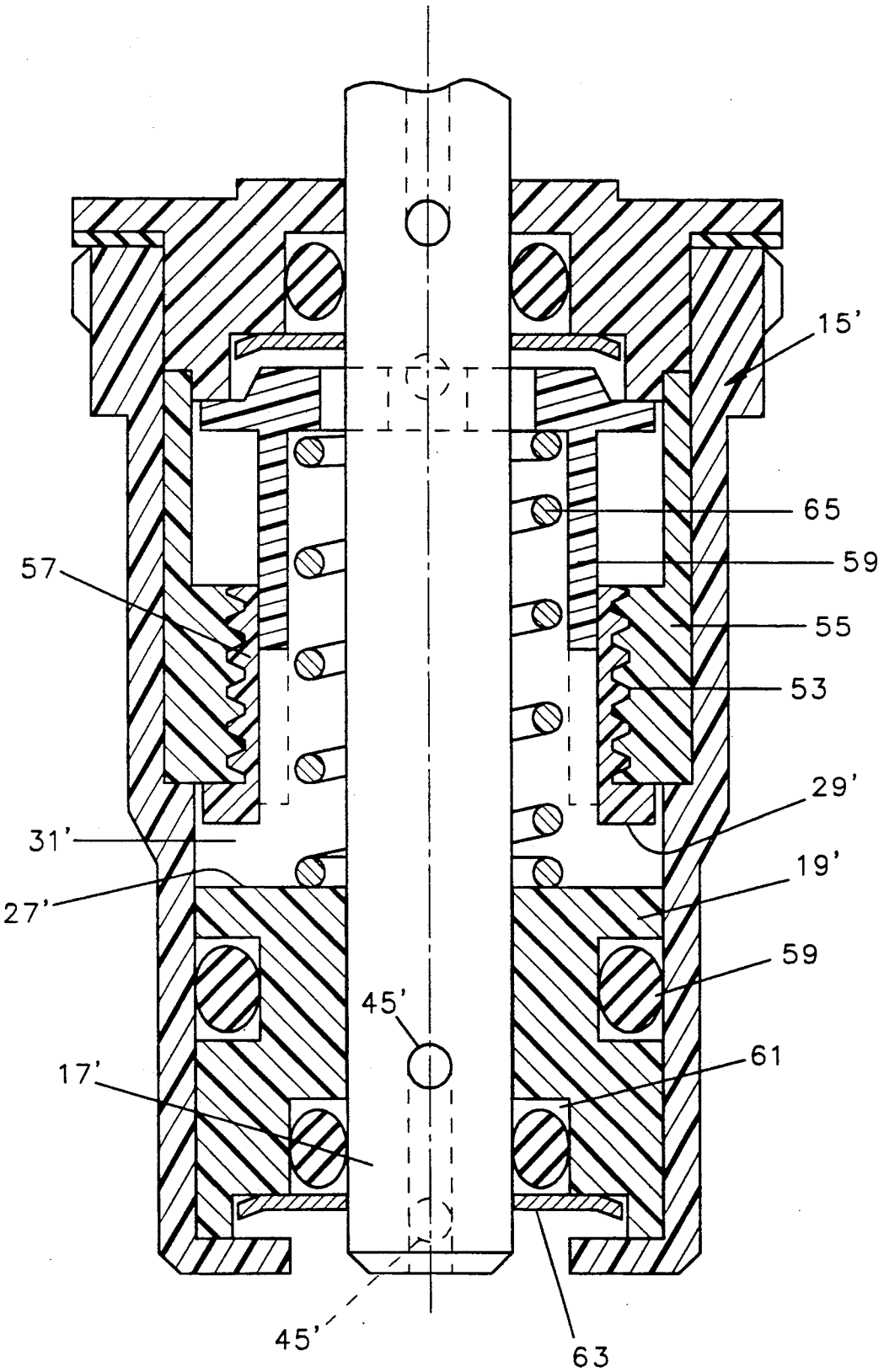
FIG. 3 is a partial cross-sectional view of another embodiment of the dispensing apparatus of this invention with an adjustable dose.

FIG. 3 illustrates a dispensing apparatus essentially the same as that of FIGS. 1 and 2 but with an arrangement that permits variation of the quantity of liquid to be dispensed. This is achieved by utilizing the engagement of mating threads 53 on a fixed section 55 of body 15' and a movable section 57 cooperating with stem member 17'. Prongs 59 on stem 17' engage corresponding openings on section 57 so that the latter will be rotated as stem 17' is rotated.

A piston 19' is provided with 0-rings in notches 59 and 61. Adjacent the bottom of piston 19' there is a lower sealing member 63. A single bias spring 65 is utilized instead of the pair of bias springs in the first embodiment.

To achieve adjustment of the dosage, rotation of stem member 17' causes the threads 53 to move section 57 up and down. This places surface 29' farther from or closer to surface 27', thus changing the size of chamber 31' and, hence, the amount of liquid dispensed.

With the stem in the unactuated position of FIG. 3, pressurized liquid passes through outlet 45' and past piston 17' to chamber 31'. When the stem is actuated, outlet 45' is moved to the dotted position and the liquid is dispensed as previously described.

Figure 4:
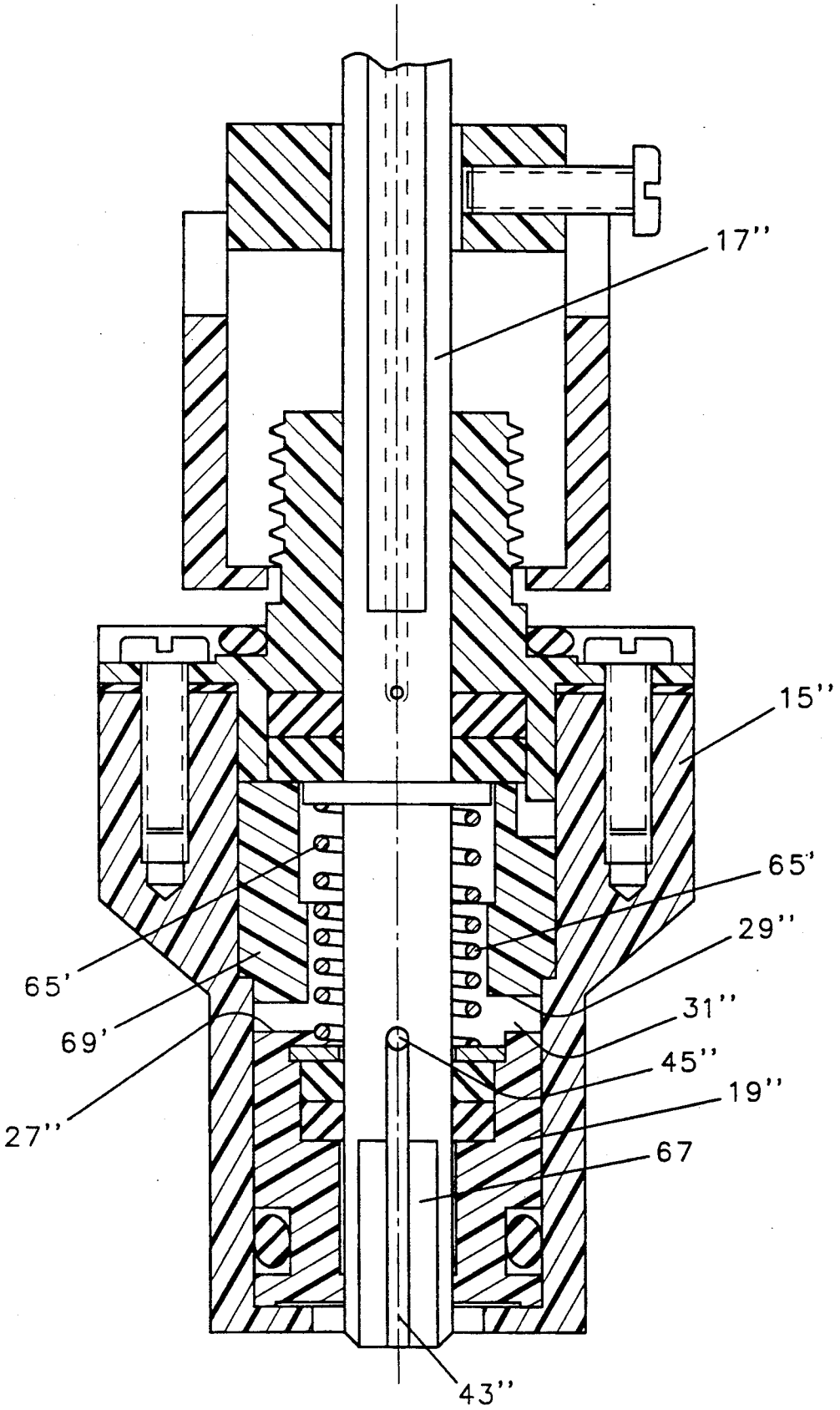
FIG. 4 is a partial cross-sectional view of yet another embodiment of the dispensing apparatus of this invention with an adjustable dose.

Another way of achieving variable dosage is shown in the embodiment of FIG. 4. In this embodiment a flattened surface 67 is provided at the lower end of stem 17" to engage a correspondingly flattened surface on the piston 19". Also, a section 69 of body portion 15" is located opposite piston 19". The opposing surfaces 27" and 29" are formed with a helical arrangement. As piston 19" is rotated with respect to section 69, the chamber 31" between surfaces 27" and 29" will be increased or decreased in size, thus varying the dosage to be dispensed.

It should be understood that various modifications, changes and variations may be made in the arrangement, operation and details of construction of the elements disclosed herein without departing from the spirit and scope of this invention.

I claim:

1. Dispensing apparatus for dispensing a predetermined quantity of a pressurized fluid comprising:

a container for pressurized fluid;

a valve assembly extending into said container from an end thereof;

a body portion of said valve assembly;

a manually actuatable elongated stem member mounted for reciprocation in said valve assembly and having a first end thereof extending out of said container;

a first passageway formed in said stem member and extending from the first end thereof to a point intermediate the ends thereof, said first passageway having an outlet to the side of said stem member at its end away from the first end of said stem member;

a second passageway formed in said stem member and extending from a second end thereof to a point intermediate the second end of said stem member and said outlet of said first passageway, said second passageway having an outlet to the side of said stem member at its end away from the second end of said stem member;

a piston mounted for reciprocable motion over a portion of said stem member adjacent the second end thereof, said piston extending along said stem member a distance less than the length of said second passageway;

first bias spring means to maintain said piston in proximity to the second end of said stem member when said stem member is not actuated, said first bias spring means producing a force under compression that is less than the force produced by the action of the pressurized liquid on the surface of said piston facing toward said second end of said stem member;

a chamber formed between the surface of said piston facing toward the first end of said stem member and an opposing surface formed on said body portion of said valve assembly, said chamber having a size, when said piston is positioned in proximity to the second end of said stem member, to contain at least the predetermined quantity of the pressurized liquid; and second bias spring means located between opposing shoulders on said body portion and said stem member to maintain said stem member in the unactuated position when no manual force is applied, in this unactuated position said outlet of said second passageway is in conjunction with said chamber while said outlet of said first passageway is not, but upon manual actuation of said stem member said outlet of said first passageway is moved into conjunction with said chamber while said outlet of said second passageway is moved out of conjunction with said chamber.

2. Dispensing apparatus for dispensing a predetermined quantity of a pressurized fluid, comprising in combination, a reservoir for holding a quantity of pressurized fluid, a metering chamber adapted to be connected to said reservoir and having a size sufficient to contain at least said predetermined quantity of pressurized fluid, actuatable discharge means adapted to disconnect said metering chamber from said reservoir and to connect said metering chamber to a discharge location for dispensing said predetermined quantity of pressurized fluid from said metering chamber, said actuable discharge means comprising a longitudinally movable stem having first and second axial bores respectively extending from opposite ends thereof and respectively opening onto said discharge location and onto said source of said pressurized fluid, first and second transverse passageways respectively connecting said axial bores to the exterior of said stem, said stem being longitudinally movable between a fill position wherein said second passageway opens onto said chamber and said first passageway is disconnected from said discharge location, and a discharge position wherein said second passageway is disconnected form said chamber and said first passageway is connected to said discharge location, and piston means defining an end wall of said metering chamber and driven by said pressurized fluid upon longitudinal movement of said stem to said discharge position to push said piston in a first direction to force said predetermined quantity of pressurized fluid from said chamber through said first transverse passageway and said first axial bore to said discharge location.

3. Dispensing apparatus as claimed in claim 2 wherein the pressurized fluid is a liquid medicament that is dispensed as a fixed unit dose.

4. Dispensing apparatus as claimed in claim 2 wherein the pressurized fluid is a liquid medicament and the apparatus further comprises selection means to adjust the dosage of medicament to be dispensed.

5. Dispensing apparatus according to claim 2, comprising means for adjusting the size of said metering chamber.

6. Dispensing apparatus according to claim 5, wherein said adjusting means is responsive to rotation of said stem.

* * * * *